US007547090B2

(12) United States Patent
Kim et al.

(10) Patent No.: US 7,547,090 B2
(45) Date of Patent: Jun. 16, 2009

(54) PRINT HEAD WIPER, INKJET IMAGE FORMING APPARATUS WITH THE SAME, AND METHOD OF MAINTAINING THE INKJET IMAGE FORMING APPARATUS

(75) Inventors: Soo-hyun Kim, Suwon-si (KR); Heon-soo Park, Seongnam-si (KR)

(73) Assignee: Samsung Electronics Co., Ltd, Suwon-si (KR)

( * ) Notice: Subject to any disclaimer, the term of this patent is extended or adjusted under 35 U.S.C. 154(b) by 412 days.

(21) Appl. No.: 11/398,683

(22) Filed: Apr. 6, 2006

(65) Prior Publication Data

US 2007/0002094 A1 Jan. 4, 2007

(30) Foreign Application Priority Data

Jul. 4, 2005 (KR) ..... 10-2005-0059668

(51) Int. Cl.
*B41J 2/165* (2006.01)

(52) U.S. Cl. ..... 347/33; 347/29; 347/32

(58) Field of Classification Search ..... 347/22–24, 347/28–36, 104
See application file for complete search history.

(56) References Cited

U.S. PATENT DOCUMENTS 5,455,609 A * 10/1995 Gast et al. ..... 347/32
5,706,038 A * 1/1998 Jackson et al. ..... 347/33
5,905,514 A * 5/1999 Rhoads et al. ..... 347/33
6,168,259 B1 * 1/2001 Capurso ..... 347/36
6,186,066 B1 2/2001 Kim
6,460,967 B1 * 10/2002 Makita et al. ..... 347/33
6,532,025 B1 * 3/2003 Hiramatsu ..... 347/29

(Continued)

FOREIGN PATENT DOCUMENTS

EP 1 405 725 * 4/2004

(Continued)

OTHER PUBLICATIONS

Korean Office Action dated Feb. 16, 2007 issued in KR 2004-59668.

(Continued)

*Primary Examiner*—Shih-Wen Hsieh
(74) *Attorney, Agent, or Firm*—Stanzione & Kim, LLP

(57) ABSTRACT

There are provided a print head wiper to wipe a nozzle surface of a print head where nozzles are formed to fire ink, an inkjet image forming apparatus including the print head wiper, and a method of maintaining the inkjet image forming apparatus. In the print head wiper, a first gear is capable of rotating in both clockwise and counterclockwise directions, a second gear is engaged with the first gear, a cleaning roller is fixed to the second gear to wipe the nozzle surface of the print head, and a link arm to connect the first gear and the second gear. When the first gear is rotated, the second gear and the cleaning roller may be revolved in an upward direction around the first gear by a frictional force between the first gear and the link arm until the cleaning roller makes contact with the nozzle surface, and then the second gear and the cleaning roller may be rotated about an axis of the second gear by a rotational force of the first gear to wipe the nozzle surface.

33 Claims, 7 Drawing Sheets

U.S. PATENT DOCUMENTS

| | | | | |
|---|---|---|---|---|
| 6,550,891 | B1 | 4/2003 | Berg | |
| 6,578,945 | B2 * | 6/2003 | Hashi et al. | 347/22 |
| 6,916,081 | B2 * | 7/2005 | Nakashima | 347/32 |
| 6,938,980 | B2 * | 9/2005 | Yakura et al. | 347/29 |
| 7,165,826 | B2 * | 1/2007 | Sugaya et al. | 347/32 |
| 7,252,363 | B2 * | 8/2007 | Takagi et al. | 347/29 |
| 7,399,056 | B2 * | 7/2008 | Nakashima et al. | 347/29 |

FOREIGN PATENT DOCUMENTS

| | | | | |
|---|---|---|---|---|
| JP | 62-288047 | | 12/1987 | |
| JP | 403099857 | A * | 4/1991 | 347/33 |
| JP | 07-164624 | | 6/1995 | |
| JP | 11-221928 | | 8/1999 | |
| JP | 2002-361879 | | 12/2002 | |
| JP | 2003-136741 | | 5/2003 | |
| JP | 2005-161870 | | 6/2005 | |
| KR | 1020020068465 | | 8/2002 | |

OTHER PUBLICATIONS

Chinese Office Action dated Jul. 4, 2008 issued in CN2006101011367.

* cited by examiner

PRINT HEAD WIPER, INKJET IMAGE FORMING APPARATUS WITH THE SAME, AND METHOD OF MAINTAINING THE INKJET IMAGE FORMING APPARATUS

CROSS-REFERENCE TO RELATED APPLICATIONS

This application claims priority under 35 U.S.C. §119(a) from Korean Patent Application No. 2005-59668, filed on Jul. 4, 2005, in the Korean Intellectual Property Office, the disclosure of which is incorporated herein in its entirety by reference.

BACKGROUND OF THE INVENTION

1. Field of the Invention

The present general inventive concept relates to an inkjet image forming apparatus, and more particularly, to a print head wiper to wipe nozzles of a print head, and an inkjet image forming apparatus including the print head wiper.

2. Description of the Related Art

Generally, inkjet image forming apparatuses form an image on a printing medium by firing ink from a print head onto the printing medium. An inkjet image forming apparatus can be classified based on a type of the print head used in the apparatus. A shuttle type print head, as it moves back and forth in the width direction of a printing medium, fires ink onto the printing medium. An array type print head includes a plurality of nozzles arranged across the width of the printing medium. Since the array type print head forms an image an entire line at a time by selectively firing ink from its nozzles, the array type print head can print images more rapidly than the shuttle type print head.

Meanwhile, to keep optimal conditions of the ink firing from the nozzles, the inkjet image forming apparatus carries out maintenance during a standby mode. The maintenance, for example, includes spitting a small amount of ink to prevent the nozzles from clogging by dust, dirt, sticking of the ink, etc, and wiping droplets of ink around the nozzles to prevent distortion of the ink firing.

For the maintenance, a print head wiper is required. Unlike the shuttle type print head, the array type print head is fixed. Therefore, the inkjet image forming apparatus including the array type print head requires a mechanism for moving the print head wiper.

SUMMARY OF THE INVENTION

The present general inventive concept provides a print head wiper, an inkjet image forming apparatus including the print head wiper, and a method of maintaining the inkjet image forming apparatus, the print head wiper being designed to operate reliably, have a simple structure, and occupy less space.

The present general inventive concept invention also provides a print head wiper to wipe a nozzle surface of a print head that includes nozzles to fire ink, and an inkjet image forming apparatus including the print head wiper.

Additional aspects and advantages of the present general inventive concept will be set forth in part in the description which follows and, in part, will be obvious from the description, or may be learned by practice of the general inventive concept.

The foregoing and/or other aspects and utilities of the present general inventive concept may be achieved by providing a print head wiper, including a first gear rotatable in both clockwise and counterclockwise directions, a second gear to engage with the first gear, the second gear being rotatable around the first gear, a cleaning roller fixed to the second gear to wipe a nozzle surface of a print head, and a link arm to connect the first gear and the second gear, wherein when the first gear is rotated, the second gear and the cleaning roller revolve in an upward direction around the first gear by a frictional force between the first gear and the link arm until the cleaning roller contacts the nozzle surface, and when the cleaning roller contacts the nozzle surface, the second gear and the cleaning roller rotate around an axis of the second gear by a rotational force of the first gear to wipe the nozzle surface.

The cleaning roller may include an outer layer formed of porous resin to facilitate absorption of the ink by the outer layer.

The cleaning roller may include an outer layer having an elliptical cross section.

The cleaning roller may include an internal heater to evaporate ink absorbed into an outer layer of the cleaning roller.

The print head wiper may further include first washers interposed between the link arm and the first gear to maintain friction between the link arm and the first gear, and second washers interposed between the link arm and the second gear to maintain friction between the link arm and the second gear.

The print head wiper may further include a cleaning solution tank containing a cleaning solution to clean the cleaning roller.

The print head wiper may further include a cleaning roller pressing part located in the cleaning solution tank to press the cleaning roller to facilitate the cleaning of the cleaning roller.

The print head may be an array type print head including the nozzle surface, the nozzle surface having a plurality of nozzles across a width of a printing medium, and the cleaning roller may have a length corresponding to a length of the nozzle surface.

The foregoing and/or other aspects and utilities of the present general inventive concept may also be achieved by providing a method of maintaining an inkjet image forming apparatus, the apparatus having a print head and a print head wiper, the print head having a nozzle surface including nozzles to fire ink, the print head wiper having a rotatable first gear, a second gear engaged with the first gear, a cleaning roller fixed to the second gear, and a link arm to connect the first gear and the second gear, the method including rotating the first gear to revolve the second gear and the cleaning roller around the first gear until the cleaning roller contacts the nozzle surface, further rotating the first gear to rotate the second gear and the cleaning roller around an axis of the second gear to wipe the nozzle surface, spraying ink from the print head toward the cleaning roller, and absorbing the sprayed ink via the cleaning roller.

The method may further include heating the cleaning roller to evaporate the absorbed ink from the cleaning roller.

The method may further include cleaning the cleaning roller with a cleaning solution.

The foregoing and/or other aspects and utilities of the present general inventive concept may also be achieved by providing a wiper unit to wipe an inkjet print head, the wiper unit including a cleaning unit to clean a nozzle surface of the print head, a rotatable cleaning gear connected to the cleaning unit to rotate the cleaning unit around an axis of the cleaning gear to clean the nozzle surface when the cleaning unit contacts the nozzle surface, a positioning gear to rotate the cleaning gear and the cleaning unit around an axis of the positioning gear to move the cleaning unit towards and away from the nozzle surface, and a driving unit to rotate the positioning gear.

The driving unit may include a worm guide to rotate the positioning gear and a motor to rotate to the worm guide. The wiper unit may further include a linker arm to connect the rotatable cleaning gear and the positioning gear, a first washer located between the linker arm and the cleaning gear to maintain a frictional force between the linker arm and the cleaning gear, and a second washer located between the linker arm and the positioning gear to maintain a frictional force between the linker arm and the positioning gear.

The foregoing and/or other aspects and utilities of the present general inventive concept may also be achieved by providing an inkjet printer, including a print head including a plurality of nozzles and a nozzle surface, a platen to support a print medium as the print medium passes under the nozzle surface, a print head wiper to move adjacent to and clean the nozzle surface when the platen is away from a moving path of the print head wiper, and a platen moving mechanism to move the platen away from the moving path of the print head wiper.

The platen may include a pair of bosses on one side of the platen, and the platen moving mechanism may include a platen motor and a platen gear to move the platen closer to or further from the nozzle surface based on a rotational direction of the platen motor. The platen moving mechanism may further include a platen worm gear located on an end of the platen motor and being engageable with the platen gear to rotate the platen gear according to the rotational direction of the platen motor. The platen moving mechanism may further include a support having cam paths, the pair of bosses being insertable into the cam paths, an arm including a slot connecting the platen gear to the support and the bosses, the platen being moveable along the cam paths closer to or further from the nozzle surface based on a rotational direction of the platen motor. The print head wiper may include an outer layer to absorb ink cleaned from the nozzle surface, and a heater to transmit heat to the outer layer to evaporate ink absorbed in the outer layer. The print head wiper may further include an inner layer to transmit the heat from the heater to the outer layer. The print head wiper includes a cleaning roller to clean a nozzle surface of the print head, a rotatable cleaning gear connected to the cleaning roller to rotate the cleaning roller around an axis of the cleaning gear to clean the nozzle surface, a positioning gear to rotate the cleaning gear and the cleaning roller around an axis of the position gear to move the cleaning roller towards and away from the nozzle surface, and a driving unit to rotate the positioning gear.

The foregoing and/or other aspects and utilities of the present general inventive concept may also be achieved by providing a cleaning roller to clean a nozzle surface of an inkjet print head, the cleaning roller including an outer layer to contact and to clean the nozzle surface, a support pipe to support the outer layer, and a heater inside of the support pipe to heat the support pipe. The support pipe may be a metallic support pipe. The heater may emit radiant heat to heat the support pipe. The outer layer may have an elliptical cross-section.

The foregoing and/or other aspects and utilities of the present general inventive concept may also be achieved by providing a cleaning unit to clean a nozzle surface of an inkjet print head, the cleaning unit including a cleaning roller to rotate around an axis thereof to clean the nozzle surface when in contact therewith, a pivoting member to pivot the cleaning roller into contact with and away from the nozzle surface, and a driving member to drive the pivoting member. The pivoting member may include a cleaning gear connected to the cleaning roller to rotate the cleaning roller around the axis thereof to clean the nozzle surface, and a positioning gear to pivot the cleaning gear and the cleaning roller around an axis of the positioning gear to move the cleaning roller into contact with and away from the nozzle surface. The positioning gear may pivot the cleaning gear and the cleaning roller around an axis of the positioning gear to move the cleaning roller towards the nozzle surface until the cleaning roller contacts the nozzle surface, the cleaning roller may rotate around the axis thereof to clean the nozzle surface when the cleaning roller contacts the nozzle surface, and the positioning gear may pivot the cleaning gear and the cleaning roller around an axis of the positioning gear to move the cleaning roller away from the nozzle surface when a predetermined period of time has expired.

The foregoing and/or other aspects and utilities of the present general inventive concept may also be achieved by providing a method of cleaning a print head of an image forming apparatus, the print head having a nozzle surface, the method including moving a platen away from the nozzle surface, rotating a cleaning unit to contact the nozzle surface, and cleaning the nozzle surface. At least one of the moving, rotating, and cleaning operations may be performed when the image forming apparatus is in a standby mode. At least one of the moving, rotating, and cleaning operations may be performed when the image forming apparatus is in a continuous printing mode.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
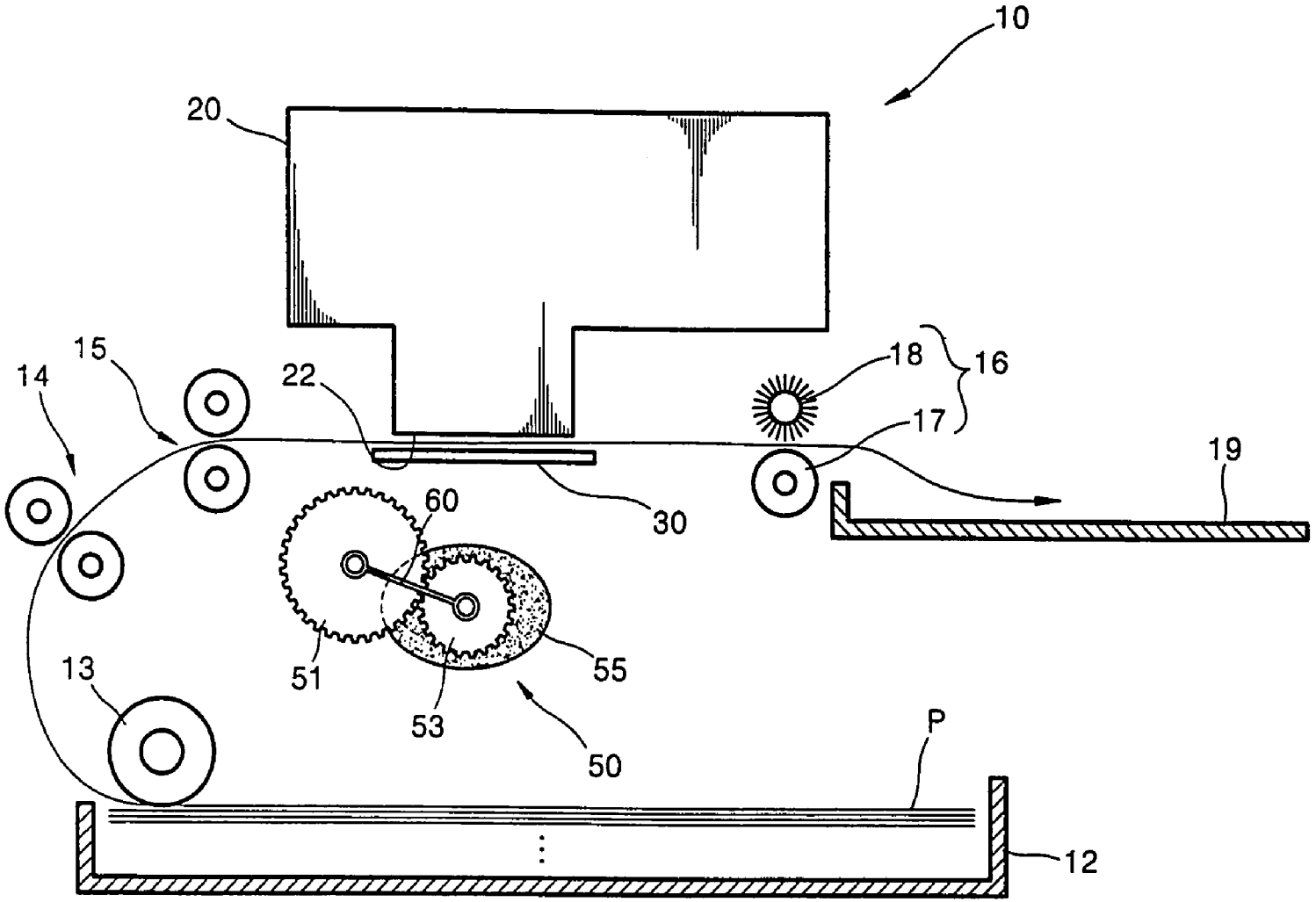
FIG. 1 illustrates a structure of an inkjet image forming apparatus according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 2:
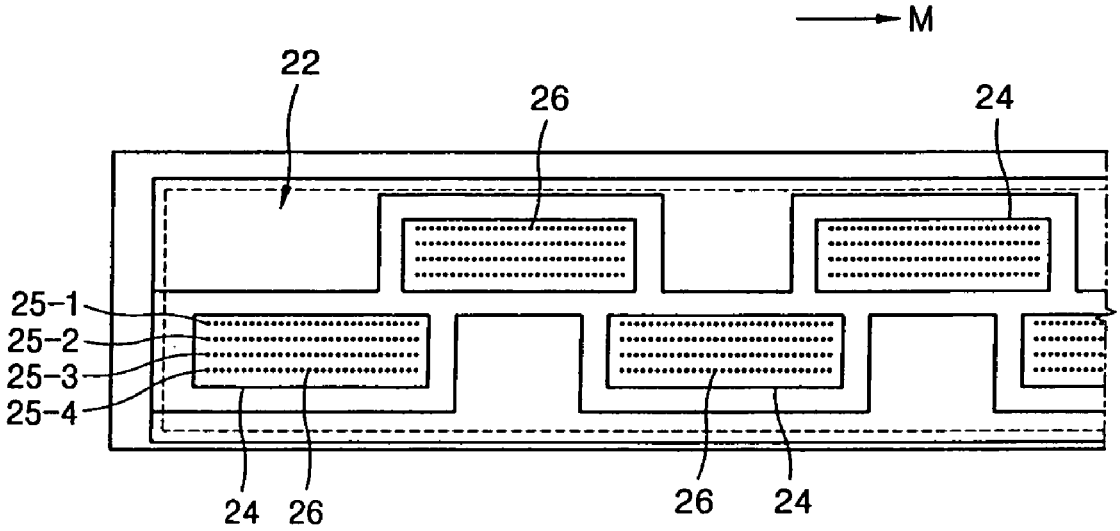
FIG. 2 is a plan view illustrating an example of a nozzle surface of a print head illustrated in FIG. 1.

FIG. 1 illustrates a structure of an inkjet image forming apparatus according to an embodiment of the present general inventive concept, and FIG. 2 is a plan view illustrating an example of a nozzle surface of a print head illustrated in FIG. 1.

Referring to FIGS. 1 and 2, an inkjet image forming apparatus 10 may include a printing media conveyer to convey a printing medium (P), a print head 20 containing ink and to fire the ink onto a printing medium (P) to form an image, a platen 30 to support the printing medium (P) when the printing medium (P) passes under a nozzle surface 22 of the print head 20, and a print head wiper 50 to wipe the nozzle surface 22 of the print head 20 during a waiting period for printing (e.g., when the inkjet image forming apparatus 10 is in stand-by mode or when the inkjet image forming apparatus 10 is between print jobs). The inkjet image forming apparatus 10 may further include a printing media cassette 12, in which a plurality the printing medium (P) can be stacked, and a printing media output tray 19 to which the plurality of the printing medium (P) are output and stacked after the image is printed on the printing medium (P).

The printing media conveyer may include an auto sheet feeder (ASF) roller 13 to pick up the printing medium (P) stacked in the media cassette 12 one-by-one, first feeder rollers 14 and second feeder rollers 15 that feed the picked-up printing medium (P) to the nozzle surface 22 of the print head 20, and ejection rollers 16 to eject the printing medium (P) to the media output tray 19 after the ink is fired onto the printing medium (P) to form the image on the printing medium (P). The ejection rollers 16 may include a driving roller 17 and a star wheel 18 facing the driving roller 17. The driving roller 17 drives the star wheel 18. If the printed printing medium (P) is pressed immediately after the ink is fired thereon, the image on the printing medium (P) can be damaged due to a spreading the ink on the printing medium (P). Therefore, instead of using an idle roller, the star wheel 18 is used for the ejection rollers 16.

The print head 20, as illustrated in FIG. 2, is an array type print head including the nozzle surface 22 extending in a width direction of the printing medium (P) (i.e., in a main scanning direction M). A length of the nozzle surface 22 along the main scanning direction M may correspond to the width of the printing medium (P). The nozzle surface 22 includes a plurality of nozzle chips 24 that may be arranged along the main scanning direction in a staggered manner. Each of the nozzle chips 24 is formed with a plurality of nozzles 26 to fire ink. The nozzle chip 24 may include a plurality of nozzle rows 25-1, 25-2, 25-3, and 25-4. The nozzle rows 25-1, 25-2, 25-3, and 25-4 may fire ink of the same color, or they may fire ink of different colors (e.g., cyan, magenta, yellow, and black), respectively. A shape of the nozzle surface 22 illustrated in FIG. 2 is an exemplary one. That is, the present general inventive concept is not limited to the shape of the nozzle surface 22 illustrated in FIG. 2.

Though not illustrated, the print head 20 includes chambers and passages to supply ink to the chambers. Each of the chambers communicates with the nozzle 26 and includes an ejection unit (e.g., a piezoelectric unit or a heater) to generate pressure to eject the ink. The chamber, the ejection unit, and the passage are well known to those of skill in the related art. Thus, descriptions thereof will be omitted.

The platen 30 is placed to face the nozzle surface 22 to keep the printing medium (P) spaced a predetermined distance from the nozzle surface 22 when the printing medium (P) passes under the nozzle surface 22. In various embodiments, the platen 30 may be at a distance of about 0.5 mm to about 2 mm apart from the nozzle surface 22 when the printing medium (P) passes under the nozzle surface 22. For example, the platen 30 may be a distance of about 0.5 mm to about 1 mm apart from the nozzle surface 22, or at a distance of about 1 mm to about 2 mm apart from the nozzle surface 22, when the printing medium (P) passes under the nozzle surface 22.

An embodiment of a printing operation using the inkjet image forming apparatus 10 will now be described.

The ASF roller 13 picks up the printing medium (P) stacked in the media cassette 12, and the first and second feeder rollers 14 and 15 feed the picked-up printing medium (P) to pass the printing medium (P) between the nozzle surface 22 of the print head 20 and the platen 30 at a constant speed. While the printing medium (P) advances at the constant speed, the nozzles 26 formed in the nozzle surface 22 selectively fire ink onto the printing medium (P) in a predetermined pattern to form the image. After the firing of the ink onto the print medium (P), the ejection rollers 16 stack the printed printing medium (P) in the media output tray 19.

The inkjet image forming apparatus 10 carries out maintenance at intervals during a standby mode or between print jobs during continuous printing. For the maintenance, the platen 30 is spaced apart from the nozzle surface 22 to expose the nozzle surface 22 and allow the print head wiper 50 to have access to the nozzle surface 22 without interference from the platen 30.

Figure 3:
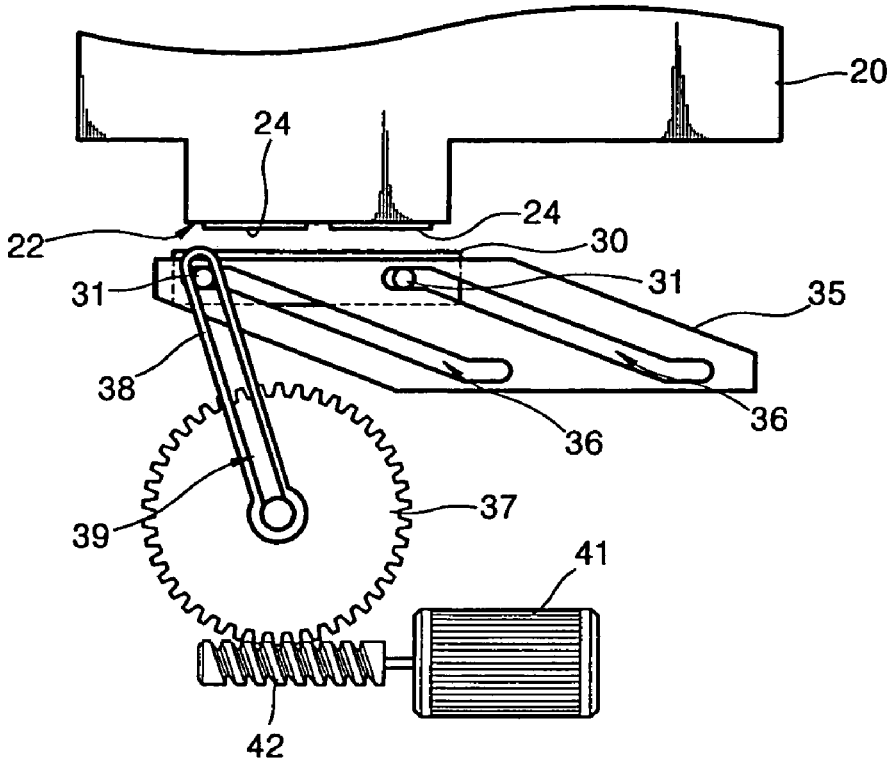
FIGS. 3 and 4 illustrate a mechanism to switch a position of a platen depicted in FIG. 1.
Figure 4:
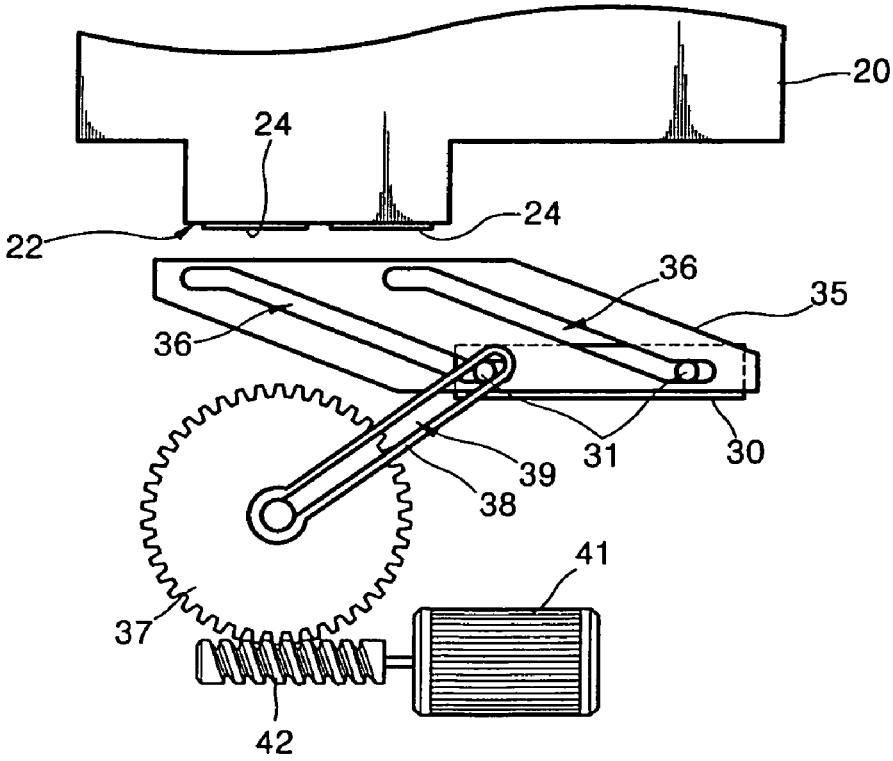

FIGS. 3 and 4 illustrate a mechanism to switch a position of the platen 30 depicted in FIG. 1, FIG. 3 illustrating the platen 30 in a position closer to a nozzle surface and FIG. 4 illustrating the platen 30 in a position spaced farther apart from the nozzle surface.

Referring to FIGS. 3 and 4, the platen 30 may include a pair of bosses 31 on one side of the platen 30. The bosses 31 are insertable into cam paths 36 formed in a support 35, respectively. A gear 37 includes an arm 38 defining a slot 39, and one of the bosses 31 is inserted in the slot 39. A worm gear 42 is provided on an end of a shaft of a motor 41. The worm gear 42 is engaged with the gear 37. Depending on the rotational direction of the motor 41, the platen 30 is moved along the cam paths 36 to a lower position, farther apart from the nozzle surface 22, as illustrated in FIG. 4, or to an upper position, closer to the nozzle surface 22, as illustrated in FIG. 3.

Figure 10:
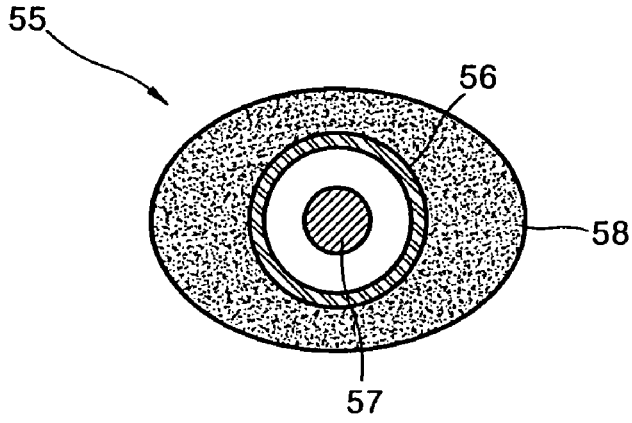
FIG. 10 is a sectional view illustrating an example of a cleaning roller of the print head illustrated in FIG. 1.

FIGS. 5 through 9 illustrate a maintenance operation of the print head wiper 50 illustrated in FIG. 1, and FIG. 10 is a sectional view of a cleaning roller of the print head 20 illustrated in FIG. 1.

Referring to FIGS. 5 through 9, the print head wiper 50 may include a first gear 51, a second gear 53 engageable with the first gear 51, a cleaning roller 55 fixed to the second gear 53, and a link arm 60 to connect the first gear 51 and the second gear 53. The first gear 51 may be engaged with a worm gear 72 formed on an end of a shaft of a motor 71, and the first gear 51 can be rotated in both clockwise and counterclockwise directions.

The link arm 60 has a first end connectable to a center of the first gear 51 and a second end connectable to a center of the second gear 53. A washer 64 may connect the center of the first gear 51 and the first end of the link arm 60 to maintain a frictional force between the first gear 51 and the first end of the link arm 60. Further, a washer 65 may connect the center of the second gear 53 and the second end of the link arm 60 to maintain a frictional force between the second gear 53 and the second end of the link arm 60. The washers 64 and 65 may be fitted within the centers of the first gear 51 and the second gear 53, respectively. Therefore, when the first gear 51 is rotated, the second gear 53 is revolved about the first gear 51 by the frictional forces between the link arm 60 and the first gear 51 and between the link arm 60 and the second gear 53. For example, if the first gear 51 is rotated in the counterclockwise direction, the second gear 53 may be revolved in an upward direction, and if the first gear 51 is rotated in the clockwise direction, the second gear 53 may be revolved in a downward direction. When the upward or downward revolution of the second gear 53 is restricted by an obstacle, the second gear 53 is not revolved around the first gear 51; however, the second gear 53 is still rotatable around its own axis by a driving force transmitted from the first gear 51.

The cleaning roller 55 may have a length corresponding to a length of the nozzle surface 22. The cleaning roller 55 may be fixed to the second gear 53 such that the cleaning roller 55 revolves and rotates with the second gear 53. When the cleaning roller 55 comes into contact with the nozzle surface 22, the cleaning roller 55 is rotated together with the second gear 53 about the axis of the second gear 53 to wipe the nozzle surface 22.

Referring to FIG. 10, the cleaning roller 55 may include an outer layer 58, a metallic support pipe 56 to support the outer layer 58, and a heater 57 inside the support pipe 56 to heat the support pipe 56. The outer layer 58 may be formed of, for example, a porous resin to facilitate absorption of wiped or sprayed ink from the nozzle surface 22. The outer layer 58 may have an elliptical cross section so that the nozzle surface 22 can be entirely cleaned by the rotation of the cleaning roller 55 without leaving a non-cleaned portion of the nozzle surface 22.

The heater 57 may emit radiant heat to heat the support pipe 56, which in turn heats the outer layer 58. The heater 57 may be any heater suitable to emit radiant heat to the support pipe 56, such as a halogen lamp. However, the heater 57 is not limited to being a halogen lamp. The ink absorbed in the outer layer 58 after wiping or spraying is evaporated by the heat generated from the heater 57. Therefore, the print head wiper 50 does not require an additional tray to contain the wiped or sprayed ink.

Hereinafter, an embodiment of a method of maintaining the print head wiper 50 will be described with reference to FIGS. 1 and 5 through 10.

Figure 5:
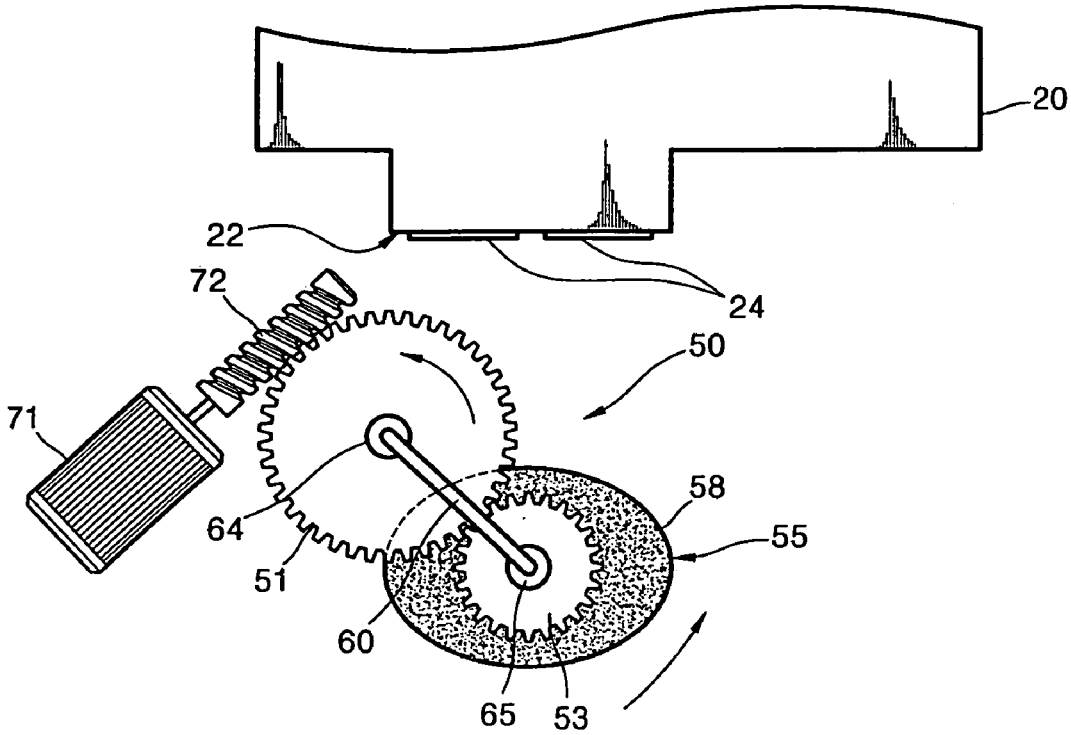
FIGS. 5 through 9 illustrate a method of maintaining a print head wiper illustrated in FIG. 1 according to an embodiment of the present general inventive concept.
Figure 6:
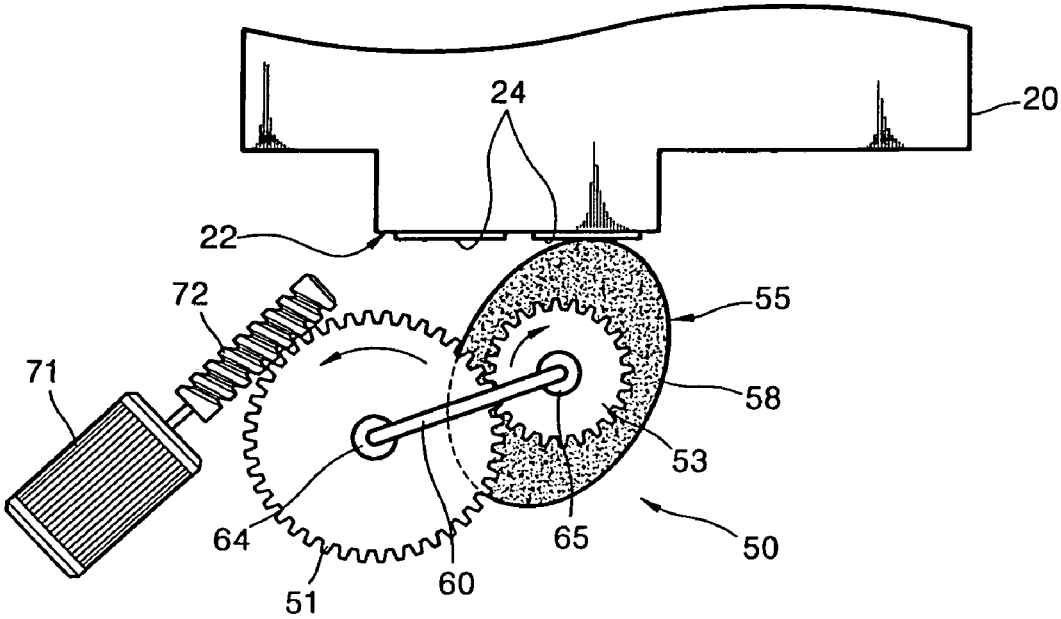

First, when the platen 30 (see FIG. 1) is spaced apart from the nozzle surface 22 by the predetermined distance and the cleaning roller 55 is located at a lower position apart from the nozzle surface 22 as illustrated in FIG. 5, the first gear 51 is rotated in a counterclockwise direction (i.e., in the direction of the arrow in the first gear 51 in FIGS. 5-7) to raise the second gear 53 and the cleaning roller 55 toward the nozzle surface 22. As the second gear 53 and the cleaning roller 55 are being raised, the cleaning roller 55 makes contact with the nozzle surface 22 as illustrated in FIG. 6. After the cleaning roller 55 makes contact with the nozzle surface 22, the second gear 53 and the cleaning roller 55 are prevented from revolving further about the first gear 51, as the nozzle surface acts as an obstacle that prevents the second gear 53 and the cleaning roller 55 from revolving about the first gear 51. However, as illustrated in FIG. 7, the second gear 53 and the cleaning roller 55 are rotated about an axis of the second gear 53 in a clockwise direction (i.e., in the direction of the arrow in the second gear 65 in FIG. 7) by the counterclockwise rotation of the first gear 51, so that the nozzle surface 22 can be wiped by the outer layer 58 of the cleaning roller 55.

Figure 7:
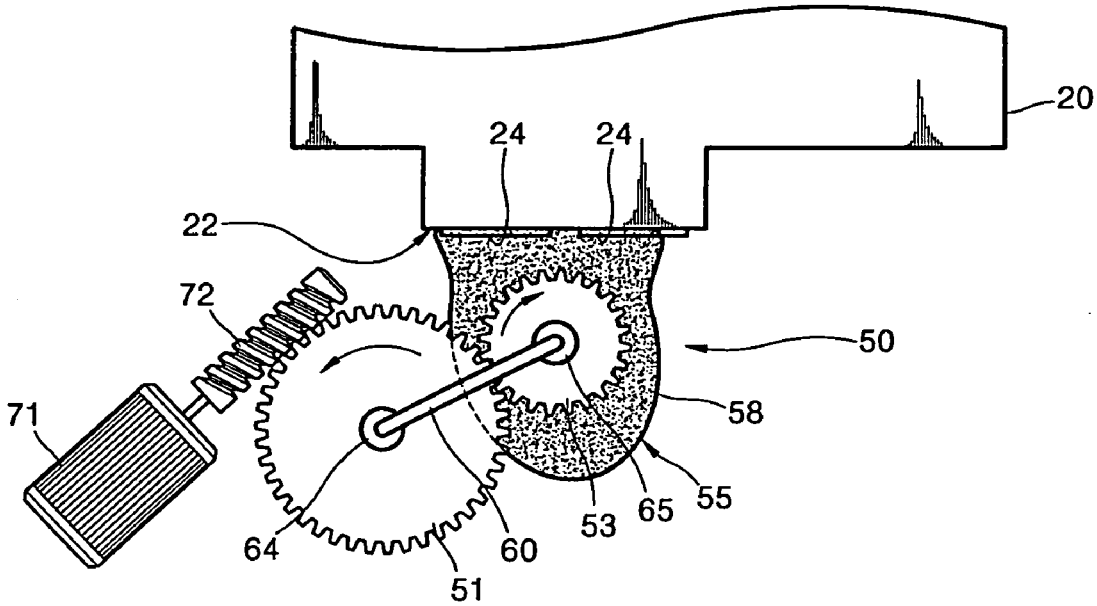
Figure 8:
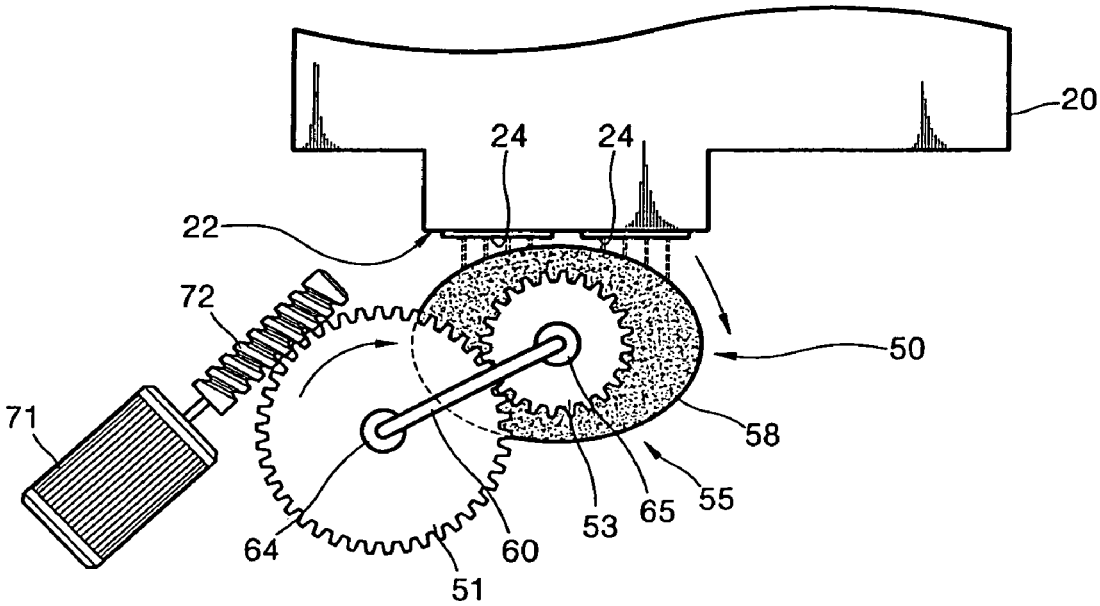
Figure 9:
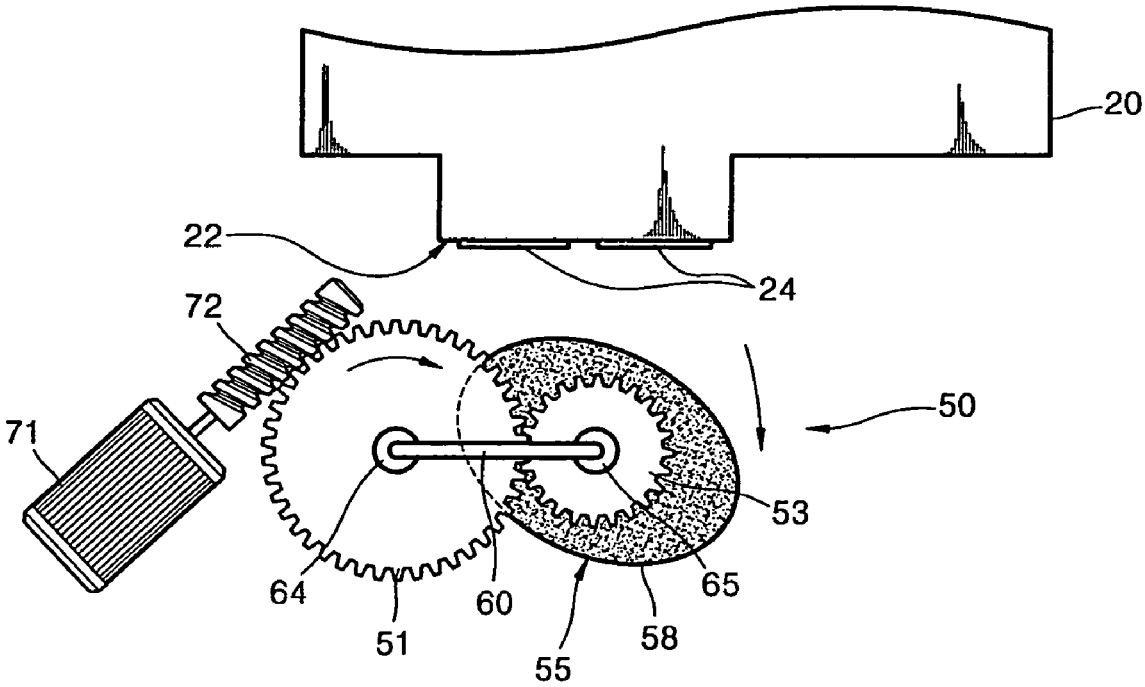

When the outer layer 58 covers the nozzle chips 24 as illustrated in FIG. 7, or when the outer layer 58 is slightly spaced from the nozzle chips 24 as illustrated in FIG. 8, the print head 20 sprays ink onto the outer layer 58 of the cleaning roller 55. The sprayed ink is entirely absorbed into the outer layer 58 without dripping, so that the inside of the image forming apparatus 10 (see FIG. 1) does not become contaminated. After the spraying of the ink, the first gear 51 is rotated in a clockwise direction as indicated by the arrow in the first gear 51 illustrated in FIG. 9. As discussed above, the print head wiper 50 wipes the nozzle surface 22 of the print head 20 when, for example, the inkjet image forming apparatus 10 is in stand-by mode or when the inkjet image forming apparatus 10 is between print jobs during continuous printing. Thus, the motor 71 rotates the first gear 51 in a clockwise direction to move the cleaning roller 55 away from the nozzle surface 22 when a predetermined period of time has expired (for example, after an interval of time has passed while the image forming apparatus 10 is in the stand-by mode) or when the image forming apparatus 10 is about to start a subsequent print job (for example, during continuous printing).

As a result, the second gear 53 and the cleaning roller 55 are revolved in the downward direction around the first gear 51 to the lower position, farther away from the nozzle surface, as illustrated in FIG. 5. Meanwhile, after the spraying of the ink, the heater 57 (see FIG. 10) located in the cleaning roller 55 can heat the metallic support pipe 56, which in turn heats the outer layer 58 to evaporate the ink absorbed in the outer layer 58.

Figure 11:
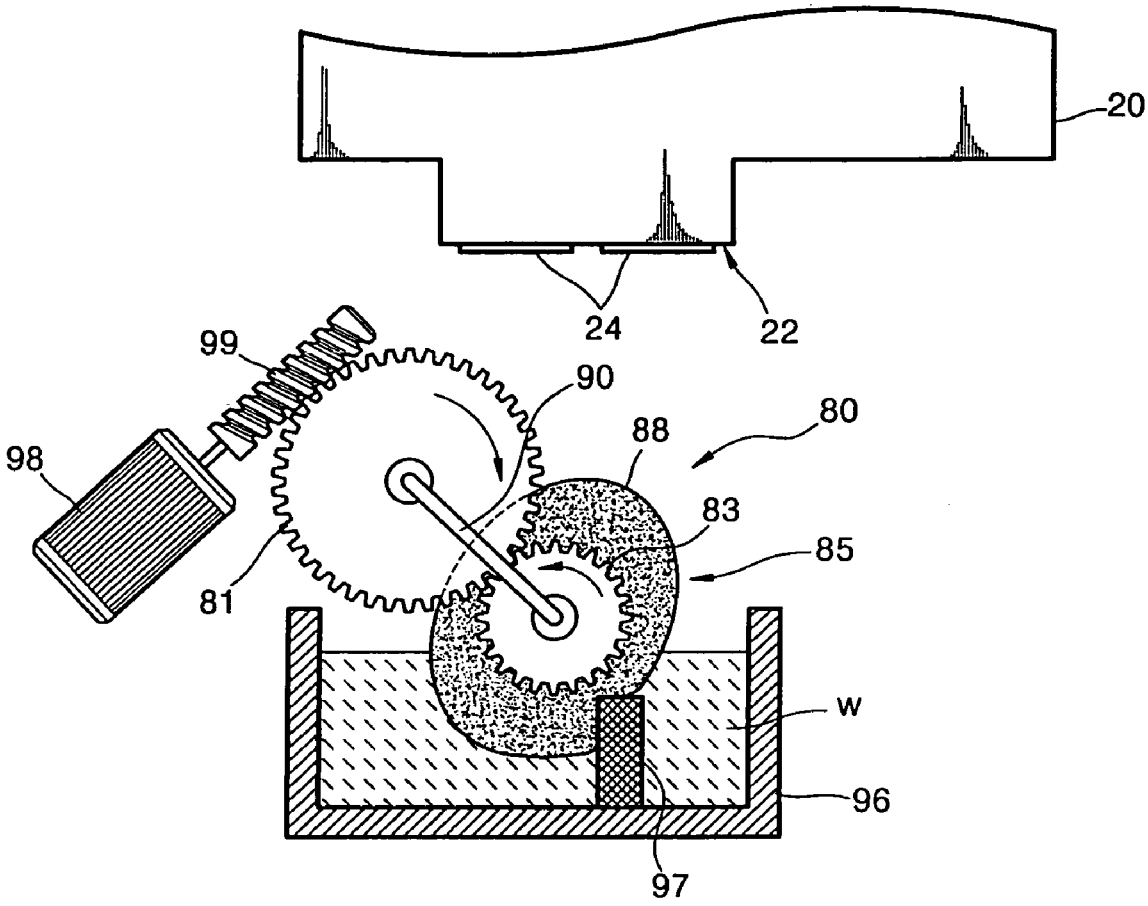
FIG. 11 illustrates an embodiment of a print head wiper according to an embodiment of the present general inventive concept.

FIG. 11 illustrates a print head wiper according to another embodiment of the present general inventive concept. Referring to FIG. 11, a print head wiper 80 has a similar structure to the print head wiper 50 illustrated in FIGS. 5 through 9. That is, the print head wiper 80 may include a first gear 81, a second gear 83 engageable with the first gear 81, a cleaning roller 85 fixed to the second gear 83, and a link arm 90 to connect the first gear 81 and the second gear 83. The first gear 81 is engageable with a worm gear 99 formed on an end of a shaft of a motor 98, and the first gear 81 can be rotated in both clockwise and counterclockwise directions.

However, the print head wiper 80 is different from the print head wiper 50 illustrated in FIGS. 5 through 9 in that the print head wiper 80 further includes a cleaning solution tank 96 and a cleaning roller pressing part 97 located in the cleaning solution tank 96. The cleaning solution tank 96 contains cleaning solution (w) to clean an outer layer 88 of the cleaning roller 85. Specifically, after the cleaning roller 85 has cleaned the nozzle surface 22, and is thus contaminated by wiped and sprayed ink fired from the print head 20, the cleaning roller 85 is lowered into the cleaning solution (w) to be cleaned. By cleaning the cleaning roller 85 in this manner, the cleaning roller 85 can be used for a much longer period of time, i.e., a lifespan of the cleaning roller 85 can be extended.

Specifically, when the first gear 81 is rotated in a clockwise direction (i.e., in the direction of the arrow in the first gear 81 in FIG. 11), the cleaning roller 85 is lowered to make contact with the cleaning roller pressing part 97. After the cleaning roller 85 makes contact with the pressing part 97, the cleaning roller 85 and the second gear 83 are prevented from being further revolved around the first gear 81, the pressing part 97 being an obstacle to prevent the cleaning roller 85 and the second gear 83 from revolving around the first gear 81. However, the cleaning roller 85 and the second gear 83 rotate in a counterclockwise direction around an axis of the second gear 83 (i.e., in the direction of the arrow in the second gear 83 in FIG. 11). During the rotation of the cleaning roller 85 around the axis of the second gear 83, the outer layer 88 of the cleaning roller 85 immersed in the cleaning solution (w), and is compressed by the cleaning roller pressing part 97. The outer layer 88 of the cleaning roller 85 is then expanded to its original shape after being removed from the cleaning roller pressing part 97. Due to the compression and expansion of the outer layer 88 in the cleaning solution (w), the outer layer 88 can be effectively-cleaned.

In various embodiments, the method of maintaining the inkjet image forming apparatus using the print head wiper 80 illustrated in FIG. 11 may further include cleaning the cleaning roller 85, contaminated by the ink, with the cleaning solution (w).

According to various embodiments of the present general inventive concept, an inkjet image forming apparatus including a print head wiper can provide improved image quality by carrying out reliable maintenance of nozzles of the inkjet image forming apparatus.

According to various embodiments of the present general inventive concept, wiped and sprayed ink is absorbed by a cleaning roller, and then the absorbed ink is evaporated by heat, so that an inside of the image forming apparatus can be protected from contamination. Further, an additional tray is not required to collect the absorbed ink, thereby providing an image forming apparatus having a simple structure.

According to various embodiments of the present general inventive concept, a cleaning roller contaminated by ink can be cleaned by a cleaning roller presser part and/or by a cleaning solution, so that the consumable cleaning roller can be used much longer, i.e., so that the lifespan of the cleaning roller can be extended.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A print head wiper, comprising:

a first gear rotatable in both clockwise and counterclockwise directions;

a second gear to engage with the first gear, the second gear being rotatable around the first gear;

a cleaning roller fixed to the second gear to wipe a nozzle surface of a print head; and a link arm to connect the first gear and the second gear, wherein when the first gear is rotated, the second gear and the cleaning roller revolve in an upward direction around the first gear by a frictional force between the first gear and the link arm until the cleaning roller contacts the nozzle surface, and when the cleaning roller contacts the nozzle surface, the second gear and the cleaning roller rotate around an axis of the second gear by a rotational force of the first gear to wipe the nozzle surface.

2. The print head wiper of claim 1, wherein the cleaning roller includes an outer layer formed of porous resin to facilitate absorption of the ink by the outer layer.

3. The print head wiper of claim 1, wherein the cleaning roller includes an outer layer having an elliptical cross section.

4. The print head wiper of claim 1, wherein the cleaning roller includes an internal heater to evaporate ink absorbed into an outer layer of the cleaning roller.

5. The print head wiper of claim 1, further comprising:

first washers interposed between the link arm and the first gear to maintain friction between the link arm and the first gear; and second washers interposed between the link arm and the second gear to maintain friction between the link arm and the second gear.

6. The print head wiper of claim 1, further comprising a cleaning solution tank containing a cleaning solution to clean the cleaning roller.

7. The print head wiper of claim 6, further comprising a cleaning roller pressing part located in the cleaning solution tank to press the cleaning roller to facilitate the cleaning of the cleaning roller.

8. The print head wiper of claim 1, wherein:

the print head is an array type print head including the nozzle surface, the nozzle surface having a plurality of nozzles across a width of a printing medium, and the cleaning roller has a length corresponding to a length of the nozzle surface.

9. An inkjet image forming apparatus, comprising:

a print head having a nozzle surface including nozzles to fire ink; and a print head wiper to wipe the nozzle surface, the print head wiper comprising:

a first gear rotatable in both clockwise and counterclockwise directions;

a second gear to engage with the first gear, the second gear being rotatable around the first gear;

a cleaning roller fixed to the second gear to wipe the nozzle surface of the print head; and a link arm to connect the first gear and the second gear, wherein when the first gear is rotated, the second gear and the cleaning roller revolve in an upward direction around the first gear by a frictional force between the first gear and the link arm until the cleaning roller contacts the nozzle surface, and when the cleaning roller contacts the nozzle surface, the second gear and the cleaning roller rotate around an axis of the second gear by a rotational force of the first gear to wipe the nozzle surface.

10. The inkjet image forming apparatus of claim 9, wherein the cleaning roller includes an outer layer formed of porous resin to facilitate absorption of the ink by the outer layer.

11. The inkjet image forming apparatus of claim 9, wherein the cleaning roller includes an outer layer having an elliptical cross section.

12. The inkjet image forming apparatus of claim 9, wherein the cleaning roller includes an internal heater to evaporate ink absorbed into an outer layer of the cleaning roller.

13. The inkjet image forming apparatus of claim 9, further comprising:

first washers interposed between the link arm and the first gear to maintain friction between the link arm and the first gear; and second washers interposed between the link arm and the second gear to maintain friction between the link arm and the second gear.

14. The inkjet image forming apparatus of claim 9, wherein the print head wiper further comprises a cleaning solution tank containing a cleaning solution to clean the cleaning roller.

15. The inkjet image forming apparatus of claim 14, wherein the print head wiper further comprises a cleaning roller pressing part located in the cleaning solution tank to press the cleaning roller to facilitate the cleaning of the cleaning roller.

16. The inkjet image forming apparatus of claim 9, wherein the print head is an array type print head including the nozzle surface, the nozzle surface having a plurality of nozzles across a width of a printing medium, and the cleaning roller has a length corresponding to a length of the nozzle surface.

17. A method of maintaining an inkjet image forming apparatus having a print head and a print head wiper, the print head having a nozzle surface including nozzles to fire ink, the print head wiper having a rotatable first gear, a second gear engaged with the first gear, a cleaning roller fixed to the second gear, and a link arm to connect the first gear and the second gear, the method comprising:

rotating the first gear to revolve the second gear and the cleaning roller around the first gear until the cleaning roller contacts the nozzle surface;

further rotating the first gear to rotate the second gear and the cleaning roller around an axis of the second gear to wipe the nozzle surface;

spraying ink from the print head toward the cleaning roller; and absorbing the sprayed ink via the cleaning roller.

18. The method of claim 17, further comprising heating the cleaning roller to evaporate the absorbed ink from the cleaning roller.

19. The method of claim 17, further comprising cleaning the cleaning roller with a cleaning solution.

20. A wiper unit to wipe an inkjet print head, the wiper unit comprising:

a cleaning unit to clean a nozzle surface of the print head;

a rotatable cleaning gear connected to the cleaning unit to rotate the cleaning unit around an axis of the cleaning gear to clean the nozzle surface when the cleaning unit contacts the nozzle surface;

a positioning gear to rotate the cleaning gear and the cleaning unit around an axis of the positioning gear to move the cleaning unit towards and away from the nozzle surface; and a driving unit to rotate the positioning gear, wherein the driving unit comprises a worm guide to rotate the positioning gear and a motor to rotate to the worm guide.

21. An inkjet printer, comprising:

a print head including a plurality of nozzles and a nozzle surface;

a platen which comprises a pair of bosses on one side of the platen to support a print medium as the print medium passes under the nozzle surface;

a print head wiper to move adjacent to and clean the nozzle surface when the platen is away from a moving path of the print head wiper; and a platen moving mechanism to move the platen away from the moving path of the print head wiper, the platen moving mechanism comprises a platen motor and a platen gear to move the platen closer to or further from the nozzle surface based on a rotational direction of the platen motor.

22. The inkjet printer of claim 21, wherein the platen moving mechanism further comprises a platen worm gear located on an end of the platen motor and being engageable with the platen gear to rotate the platen gear according to the rotational direction of the platen motor.

23. The inkjet printer of claim 22, wherein the platen moving mechanism further comprises:

a support having cam paths, the pair of bosses being insertable into the cam paths; and an arm including a slot connecting the platen gear to the support and the bosses, the platen being moveable along the cam paths closer to or further from the nozzle surface based on a rotational direction of the platen motor.

24. The inkjet printer of claim 21, wherein the print head wiper comprises:

an outer layer to absorb ink cleaned from the nozzle surface; and a heater to transmit heat to the outer layer to evaporate ink absorbed in the outer layer.

25. The inkjet printer of claim 24, wherein the print head wiper further comprises an inner layer to transmit the heat from the heater to the outer layer.

26. The inkjet printer of claim 21, wherein the print head wiper comprises:

a cleaning roller to clean a nozzle surface of the print head;

a rotatable cleaning gear connected to the cleaning roller to rotate the cleaning roller around an axis of the cleaning gear to clean the nozzle surface;

a positioning gear to rotate the cleaning gear and the cleaning roller around an axis of the position gear to move the cleaning roller towards and away from the nozzle surface; and a driving unit to rotate the positioning gear.

27. A cleaning roller to clean a nozzle surface of an inkjet print head, the cleaning roller comprising:

an outer layer to contact and to clean the nozzle surface;

a support pipe to support the outer layer; and a heater inside of the support pipe to heat the support pipe.

28. The cleaning roller of claim 27, wherein the support pipe is a metallic support pipe.

29. The cleaning roller of claim 27, wherein the heater emits radiant heat to heat the support pipe.

30. The cleaning roller of claim 27, wherein the outer layer has an elliptical cross-section.

31. A cleaning unit to clean a nozzle surface of an inkjet print head, the cleaning unit comprising:

a cleaning roller to rotate around an axis thereof to clean the nozzle surface when in contact therewith;

a pivoting member to pivot the cleaning roller into contact with and away from the nozzle surface, the pivoting member comprising:

a cleaning gear connected to the cleaning roller to rotate the cleaning roller around the axis thereof to clean the nozzle surface; and a positioning gear to pivot the cleaning gear and the cleaning roller around an axis of the positioning gear to move the cleaning roller into contact with and away from the nozzle surface; and a driving member to drive the pivoting member.

32. The cleaning unit of claim 31, wherein:

the positioning gear pivots the cleaning gear and the cleaning roller around an axis of the positioning gear to move the cleaning roller towards the nozzle surface until the cleaning roller contacts the nozzle surface;

the cleaning roller rotates around the axis thereof to clean the nozzle surface when the cleaning roller contacts the nozzle surface; and the positioning gear pivots the cleaning gear and the cleaning roller around an axis of the positioning gear to move the cleaning roller away from the nozzle surface when a predetermined period of time has expired.

33. A print head wiper, comprising:

a first gear rotatable about a first axis; and a second gear to engage with the first gear, the second gear rotatable about a second axis and around the first axis, wherein when the first gear is rotated in a first direction, the second gear rotates about the second axis and around the first axis to allow a cleaning portion of the second gear to contact a nozzle surface of a print head.

* * * * *